US009617762B2

(12) United States Patent
Fannon et al.

(10) Patent No.: US 9,617,762 B2
(45) Date of Patent: Apr. 11, 2017

(54) VEHICLE HOOD RETAINER

(71) Applicant: GM Global Technology Operations LLC, Detroit, MI (US)

(72) Inventors: Joseph P. Fannon, Washington, MI (US); Craig D. Schroeder, Wyandotte, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 177 days.

(21) Appl. No.: 14/301,613

(22) Filed: Jun. 11, 2014

(65) Prior Publication Data

US 2015/0361693 A1 Dec. 17, 2015

(51) Int. Cl.

| | |
|---|---|
| ***E05C 3/16*** | (2006.01) |
| ***E05B 83/24*** | (2014.01) |
| ***E05B 17/00*** | (2006.01) |
| ***E05C 17/54*** | (2006.01) |
| ***E05C 21/00*** | (2006.01) |

(52) U.S. Cl.

CPC ..... *E05B 83/24* (2013.01); *E05B 17/0012* (2013.01); *E05C 17/54* (2013.01); *E05C 21/005* (2013.01); *Y10S 292/14* (2013.01); *Y10S 292/23* (2013.01); *Y10T 292/1043* (2015.04); *Y10T 292/1047* (2015.04)

(58) Field of Classification Search

CPC .... Y10S 292/23; Y10S 292/42; Y10S 292/14; Y10T 292/1047; Y10T 292/1082; Y10T 292/1043; E05B 17/0012; E05B 63/0043; E05B 83/24; E05B 2015/0285; E05C 17/54; E05C 21/005; B62D 25/10; B62D 25/105

USPC ..... 292/216, 201, DIG. 23, DIG. 42, 292/DIG. 14; 296/193.11; 180/69.2, 180/69.21

See application file for complete search history.

(56) References Cited

U.S. PATENT DOCUMENTS

| | | | | | |
|---|---|---|---|---|---|
| 2,618,497 | A * | 11/1952 | Gardels | E05C 17/042 | 217/61 |
| 4,070,050 | A * | 1/1978 | Glock | E05C 17/042 | 292/339 |
| 4,322,103 | A * | 3/1982 | Acton | E05C 17/047 | 292/262 |
| 4,593,946 | A * | 6/1986 | Rich | B05B 13/0292 | 292/262 |
| 5,551,738 | A * | 9/1996 | Thorlton | E05C 17/042 | 24/598.6 |
| 2011/0006551 | A1* | 1/2011 | Konchan | E05B 83/16 | 292/216 |

FOREIGN PATENT DOCUMENTS

| | | | | |
|---|---|---|---|---|
| CA | WO 0034608 A1 * | 6/2000 | ..... | E05C 21/005 |
| DE | 10341145 A1 * | 4/2005 | ..... | B62D 65/06 |
| FR | EP 2208841 A1 * | 7/2010 | ..... | E05C 17/047 |

* cited by examiner

*Primary Examiner* — Kristina Fulton
*Assistant Examiner* — Christine M Mills
(74) *Attorney, Agent, or Firm* — BrooksGroup

(57) ABSTRACT

A number of variations may include a product including a retainer for holding a hood in a partially open position and for releasing the hood to permit full opening movement.

5 Claims, 4 Drawing Sheets

VEHICLE HOOD RETAINER

TECHNICAL FIELD

The field to which the disclosure generally relates is vehicle hood latches.

BACKGROUND

Vehicle hoods may be equipped with a hood latch for latching the hood in a closed position, and for unlatching the hood to permit opening movement.

SUMMARY OF ILLUSTRATIVE VARIATIONS

A number of variations may include a product including a retainer for holding a hood in a partially open position and for releasing the hood to permit opening movement.

BRIEF DESCRIPTION OF THE DRAWINGS

Select examples of variations within the scope of the invention will become more fully understood from the detailed description and the accompanying drawings.

DETAILED DESCRIPTION OF ILLUSTRATIVE VARIATIONS

The following description of the variations is merely illustrative in nature and is in no way intended to limit the scope of the invention, its application, or uses.

Figure 1:
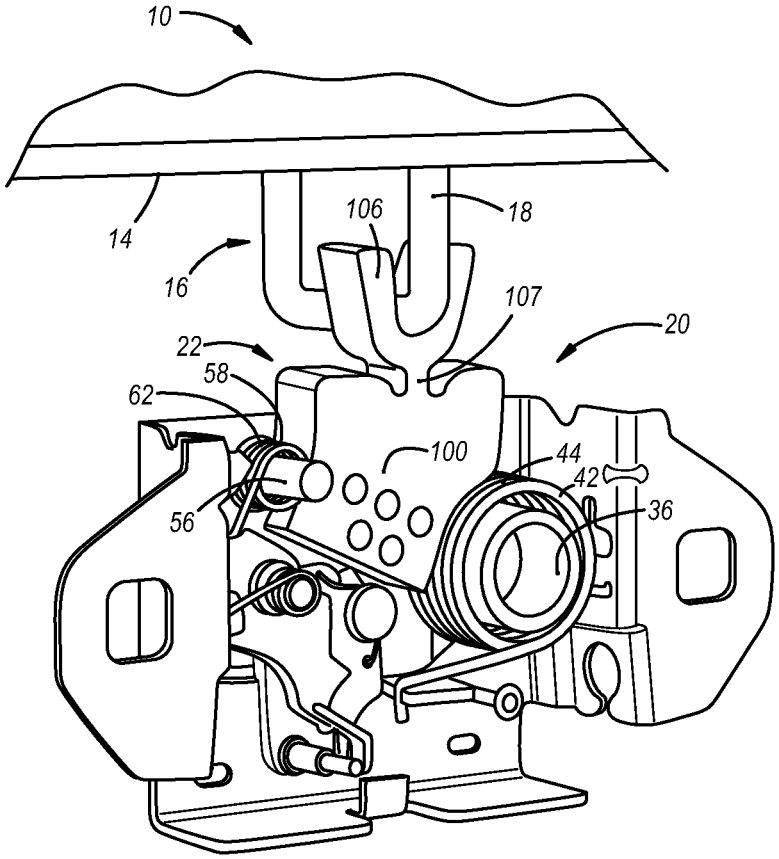
FIG. 1 is a perspective view of a vehicle hood, a hood latch, and a retainer, according to a number of variations.

A number of variations are illustrated in FIG. 1, which may include a vehicle hood, generally indicated at 10, including an inner panel 14. A striker 16, generally indicated at 16, may be a loop 18 attached to the hood 10. A hood latch 20, generally indicated at 20, may be attached to the vehicle body, for latching the hood 10 in a closed position. A retainer 22, generally indicated at 22, may be temporarily attached to the hood latch 20, and may releaseably retain the striker 16 to releaseably retain the hood 10 in a partly open position and to also enable the repeated opening and closing of the vehicle hood 10 during the manufacture of the vehicle in a vehicle assembly plant, without repeatedly operating the hood latch 20.

Figure 3:
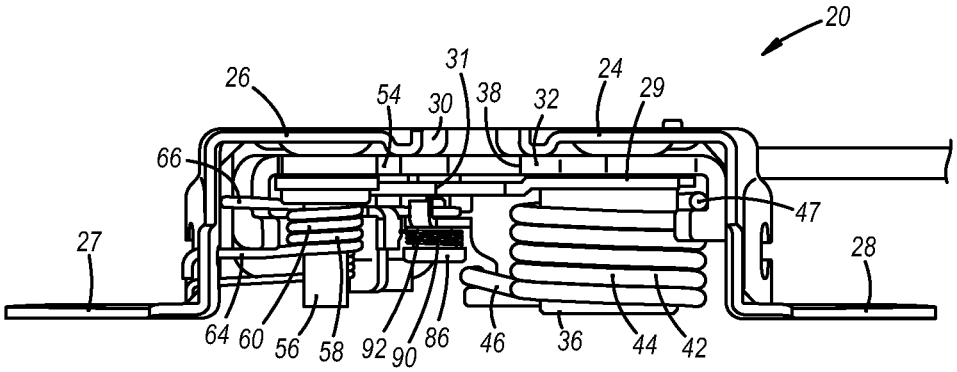
FIG. 3 is a top view of the hood latch of FIG. 2, according to a number of variations.
Figure 2:
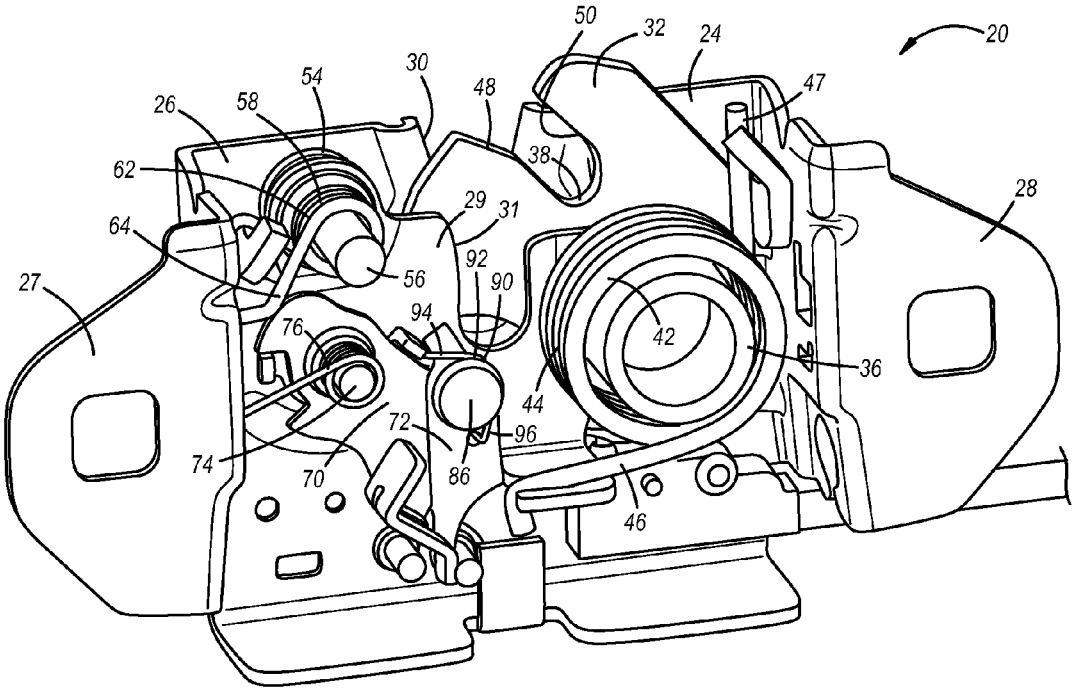
FIG. 2 is a perspective view of a hood latch according to a number of variations.

In FIGS. 2 and 3, a hood latch 20 may include a stamped housing 24 having a base wall 26 with mounting legs 27 and 28. The housing 24 may have a throat 30 for receiving the striker 16 when the hood 10 is pivoted to its closed position. The housing 24 may have an auxiliary housing plate 29 that may be spaced from the base wall 26. The auxiliary housing plate 29 may have a throat 31 that registers with the throat 30 of the base wall 26.

A forkbolt 32 may be rotateably mounted on the housing 24 by a pivot pin 36 that may be staked or welded to the housing 24. The forkbolt 32 may have a striker recess 38. In FIG. 2, the forkbolt 32 is shown rotated to its open position, in which the hood 10 has been released and may be in a fully open position providing access to an engine compartment.

A forkbolt spring 42 may bias the forkbolt 32 to the open position of FIG. 2. The forkbolt spring 42 may be a torsion spring and may have a central coil 44 that encircles the pivot pin 36, an anchor leg 46 that may be anchored on the housing 24 of latch 20, and a spring leg 47 that engages the forkbolt 32. The inside diameter of the central coil 44 may be greater than the outside diameter of the pivot pin 36, and the position of the central coil 44 may yield in a radial direction relative the pivot pin 36.

The striker recess 38 of the forkbolt 32 may have an abutment face 48 that may be engaged by the striker 16 to rotate the forkbolt 32 counterclockwise against the bias of the forkbolt spring 42 when the hood 10 is slammed to its closed position. The striker recess 38 of the forkbolt 32 may have a latch face 50 that will overlie the striker 16 when the forkbolt 32 is rotated counterclockwise to its latched position upon slamming of the hood 10 to its closed position.

The hood latch 20 may have a detent lever 54 that will engage the forkbolt 32 to retain the forkbolt 32 in its latched position when the hood 10 is slammed to its closed position. In FIG. 2, the detent lever 54 is hidden behind the auxiliary housing plate 29 of the housing 24. A pin 56 may be staked or welded to the housing 24 of the hood latch 20 and project therefrom. The detent lever 54 may be rotateably mounted on the pin 56 for rotation between positions either engaging with the forkbolt 32 to latch the position of the forkbolt 32, or disengaging and releasing from the forkbolt 32. When the detent lever 54 disengages from the forkbolt 32, the forkbolt spring 42 is enabled to forcibly bias the forkbolt 32 in the clockwise direction of FIG. 2 and thereby lift the striker 16 that had been captured in the striker recess 38, so that so that the hood 10 is popped open.

The detent lever 54 may be biased to a position engaging the forkbolt 32 by a detent spring 58 that may be mounted on the pin 56. The detent spring 58 may be a torsion spring and may have a central coil 62 that encircles the pin 56, an anchor leg 64 that may be anchored on the housing 24, and a spring leg 66 that engages the detent lever 54. The inside diameter of the central coil 62 may be greater than the outside diameter of the pin 56, and the position of the central coil 62 may yield in a radial direction relative the pivot pin 56.

The latch 20 may include additional levers, which may include a release lever 70 and an intermittent lever 72 for operating the detent lever 54 between its positions either engaging with the forkbolt 32 to latch the position of the forkbolt 32, or disengaging with the fork bolt 32 to release the forkbolt 32. The release lever 70 may be rotateably mounted on a pin 74 which may be attached to the housing 24 and may be biased by a release lever spring 76, which may be a torsion spring. The intermittent lever 72 may be rotateably mounted on a pin 86 that may be attached to the housing 24 and may be biased by an intermittent lever spring 90 having a central coil 92 encircling the pin 86, an anchor leg 94 and a spring leg 96.

Figure 4:
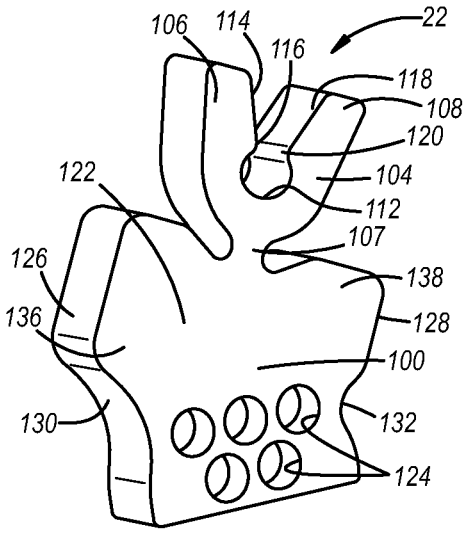
FIG. 4 is a perspective view of a retainer according to a number of variations.

Referring to FIG. 4, retainer 22 may be molded of a resilient material such as EPD M rubber. The retainer 22 may be molded in one-piece and have an attachment portion 100 for attachment to the hood latch 20, and a catch portion 104 integrally connected to the attachment portion 100. The catch portion 104 may selectively grip the striker 16 to hold the hood 10 in a partially open position of FIG. 1, and may selectively release the striker 16 to permit opening of the hood 10.

The catch portion 104 may be integrally connected to attachment portion 100 by a neck 107 that may be resilient. The catch portion 104 may have at least a first catch member 106 and may have a second catch member 108. The first catch member 106 and second catch member 108 may be spaced apart defining a notch 112 for receiving the striker 16. The first catch member 106 may have a ramp 114 that that leads into the notch 112 and an abutment 116. The second catch member 108 may have a ramp 118 and an abutment 120.

The attachment portion 100 may include a base 122 that may have a plurality of openings 124 that may contribute to the resilience of the base 122 The base 122 may have a left edge surface 126 and a right edge surface 128. The left edge surface 126 may have a concave shape 130 and the right edge surface 128 may have a concave shape 132. The base 122 may also have lateral extending shoulders 136 and 138.

Referring again to FIG. 1, the retainer 22 has been temporarily attached to the hood latch 20 by inserting the attachment portion 100 of the retainer 22 into the latch 20. The base 122 has been compressed and wedged between the central coil 44 of forkbolt spring 42 and central coil 62 of the detent spring 58. The downward insertion of retainer 22 may be limited by the shoulders 136 and 138 of the base 122 engaging with the central coils 44 and 62. The central coils 44 and 62 may also be received in the concave shapes 130 and 132 of the edge surfaces 126 and 128 of the base 122. The shoulders and the concave shapes may also stabilize and fix the position of the retainer 22 within the latch 20. The insertion of the retainer 22 may be enabled by a resilient yielding of the base 122, which may be enhanced by the presence of the openings 124. The insertion may also be enhanced by a yielding of the central coil 44 and central coils 62, which may include a radial shifting of the coils about the pins 36 and 56.

Referring again to FIGS. 1 and 4, it is seen that the hood 10 has been lowered so that the striker 16 has become engaged by the catch portion 104 of the retainer 22. During lowering of the hood 10, the striker 16 engages with the lead in ramps 114 and 118 to spread the first catch member 106 and second catch member 108 apart and allow the striker 16 to enter the notch 112. The neck 107 may resiliently yield to allow the notch 112 to align with the striker 16.

The first catch member 106 and second catch member 108 then resiliently spring back toward one another so that the abutments 116 and 120 will overlie the striker 16 to retain the striker 16 in the notch 112.

Thus, FIG. 1 shows the retainer 22 temporarily and removably attached to the latch 20 and the shows the hood striker 16 retained by the catch portion 104 so that the hood 10 is maintained in a partly open position while the vehicle is conveyed through the vehicle assembly plant. When the assembly plant operator needs to access the engine compartment, he may grip the hood 10 and lift in order to lift the striker 16 from its capture between the first catch member 106 and second catch member 108, as permitted by a resilient spreading apart of the first catch member 106 and second catch member 108. This opening and closing of the hood 10 may be accomplished without operating the forkbolt 32.

At the end of the vehicle assembly process, the retainer 22 may be removed from its engagement and attachment with the latch 20. The removal may be enabled by a resilient yielding of the base 122, which may be enhanced by the presence of the openings 124. The removal may also be enhanced by a yielding of the central coils 44 and 62, which may include a radial shifting of the coils about the pins 74 and 86. Upon removal of the retainer 22, the hood latch 20 may revert to its normal operation in which the striker 16 will be either captured or released by the forkbolt 32. The retainer 22 may be re-used within the vehicle assembly plant.

Figure 5:
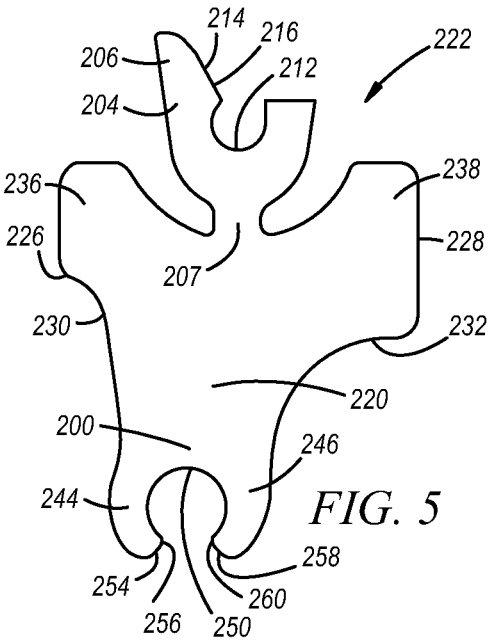
FIG. 5 is a front view of another retainer according to a number of variations.
Figure 6:
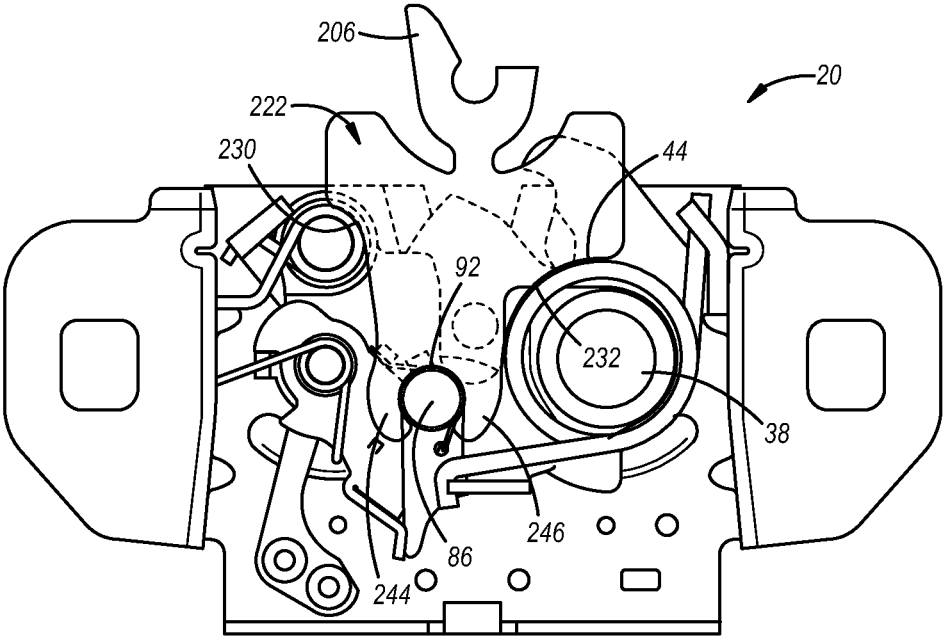
FIG. 6 shows the retainer of FIG. 5 installed in a latch according to a number of variations.

FIGS. 5 and 6 show another variation in the retainer. In FIG. 5, the retainer 222 may have an attachment portion 200 for attachment to the hood latch 20, and a catch portion 204 integrally connected to the attachment portion 200 for selectively gripping the striker 16 to retain the hood 10 in a partially open position and selectively releasing the striker 16 to permit opening of the hood 10.

The catch portion 204 may be integrally connected to the attachment portion 200 by a neck 207 that may be resilient. The catch portion 204 may have a catch member 206. The catch member 206 may define a notch 212 for receiving the striker 16. The catch member 206 may have a ramp 214 that that leads into the notch 212 and an abutment 216.

The attachment portion 200 may include a base 220. The base 220 may have a left edge surface 226 and a right edge surface 228. The left edge surface 226 may have a concave shape 230 and the right edge surface 228 may have a concave shape 232. The base 220 attachment portion 200 may also have a lateral extending shoulders 236 and 238. The base 220 may have first attachment member 244 and second attachment member 246 that may be spaced apart defining a notch 250.

The notch 250 may receive the central coil or the pin of at least one of the springs and levers of the latch 20, as shown in FIG. 6. For example, in FIG. 6, the notch 250 may receive the central coil 92 of the spring 90 of the intermittent lever 72, or may receive the end of the pivot pin 86 of the intermittent lever 72. Referring again to FIG. 5, the first attachment member 244 may have a ramp 254 that leads into the notch 250 and an abutment 256 that overlies the notch 250. The second attachment member 246 may have a ramp 258 and an abutment 260.

Referring again to FIG. 6, the retainer 222 has been temporarily attached to the hood latch 20 by inserting the attachment portion 200 of the retainer 222 into the latch 20 so that the attachment portion 200 has become temporarily attached to the latch 20 by the first attachment member 244 and second attachment member 246 resiliently spreading to receive one or both of the central coil 92 and the pin 86 within the notch 250. Retainer 222 may be stabilized against rotation about the central coil 92 or pin 86 by the concave shapes 230 and 232 of the edge surfaces 226 and 228 of the base 220 resting upon the central coils 44 and 62.

Figure 7:
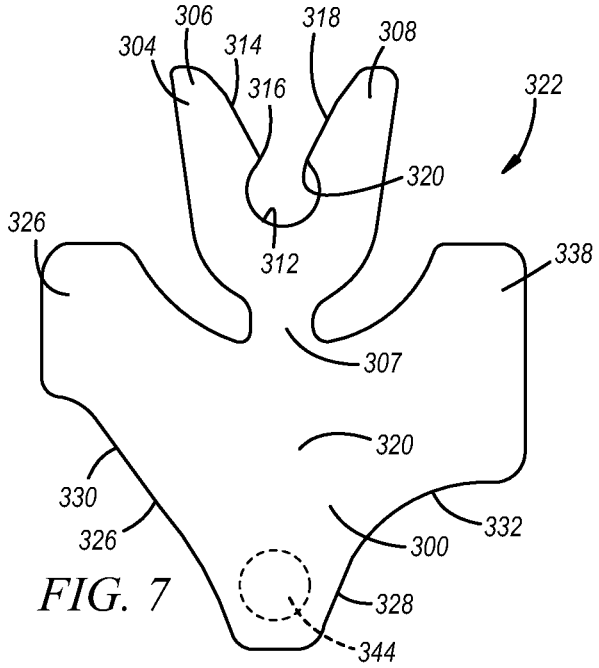
FIG. 7 is a front view of another retainer according to a number of variations.
Figure 8:
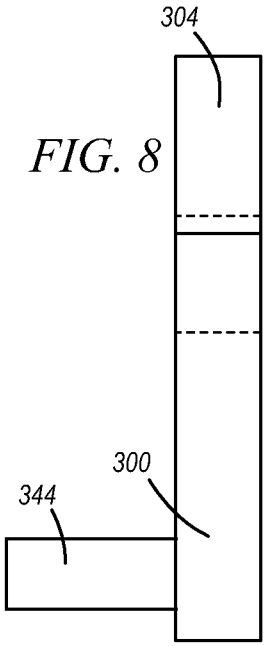
FIG. 8 is a side view of the retainer of FIG. 7, according to a number of variations.
Figure 9:
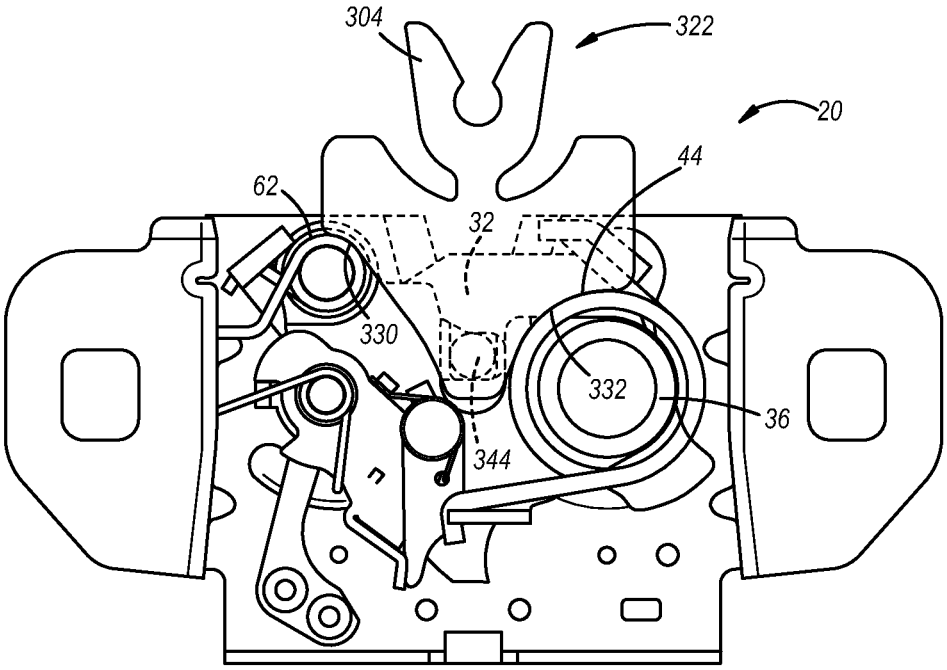
FIG. 9 shows the retainer of FIGS. 7 and 8 installed in a latch according to a number of variations.

FIGS. 7, 8 and 9 show another variation of the retainer. The retainer 322 may have an attachment portion 300 for attachment to the hood latch 20, and a catch portion 304 integrally connected to the attachment portion 300 for selectively gripping the striker 16 to retain the hood 10 in a partially open position and selectively releasing the striker 16 to permit full opening movement of the hood 10.

The catch portion 304 may be integrally connected to base portion 300 by a neck 307 that may be resilient. The catch portion 304 may have at least a first catch member 306 and may have a second catch member 308. The catch member 306 and catch member 308 may be spaced apart defining a notch 312 for receiving the striker 16. The first catch member 306 may have a ramp 314 that that leads into the notch 312 and an abutment 316. The second catch member 308 may have a ramp 318 and an abutment 320.

The attachment portion 300 may include a base 320. The base 320 may have a left edge surface 326 and a right edge surface 328. The left edge surface 326 may have a concave shape 330 and the right edge surface 328 may have a concave shape 332. The base 320 may also have extending shoulders 336 and 338. The base 320 may have a rod 344 extending laterally therefrom as seen in FIG. 8.

As shown in FIG. 9, the retainer 322 may be installed into the hood latch 20 by pressing the lateral extending rod 344 of the retainer 322 downwardly onto the forkbolt 32, so that the forkbolt 32 has rotated counter clockwise to its latching position of FIG. 9. Thus the forkbolt 32 is overlying the lateral extending rod 344 and retaining the rod 344 in the throat 30 of the housing 24. Retainer 322 may be stabilized against rotation about lateral extending pin 344 by the concave shapes 330 and 332 of the edge surfaces 326 and 328 engaging with the central coil 44 of forkbolt spring 42 and central coil 62 of the detent spring 58.

With the retainer 322 temporarily attached within the hood latch 20 as shown in FIG. 9, the hood 10 can be lowered so that the striker 16 will become engaged within the catch portion 304. Then, when desired, the assembly plant operator can open the hood by simply lifting the hood to carry the striker 16 away from its engagement within the catch portion 304. Thus, opening and closing of the hood 10 may be accomplished without operating the forkbolt 32.

At the end of the assembly line the retainer 322 can be easily removed from the vehicle by operating the latch 20 to its released position in which the fork bolt 32 will be rotated counterclockwise by the fork bolt spring 42, thereby causing the lateral extending rod 344 of the retainer 322 to be released and ejected upwardly from the latch 20.

The hood latch shown herein is merely representative of the many different hood latch designs used by various automobile manufacturers. Different manufacturers may use different arrangements of levers and springs to accomplish the latching and unlatching of a striker by a forkbolt 32. The retainer variations shown in FIGS. 4, 5, 7, and 8 may be readily adjusted and shaped to facilitate a temporary attachment to the particular hood latch employed by various manufacturers.

Variation 1 may include a product comprising a retainer constructed and arranged for use in a vehicle having a hood with a striker and a hood latch with a forkbolt operable for latching and unlatching with the striker, a retainer for temporary use to releaseably connect the striker and hood latch without latching and unlatching the forkbolt, said retainer comprising: a body of molded resilient material having an attachment portion for attachment to the hood latch and a catch portion integrally connected to the attachment portion, said catch portion having a notch for receiving the striker and at least one catch member for retaining the striker in the notch to hold the hood in a partially open position and for selectively releasing the striker to permit opening of the hood without operating the forkbolt.

Variation 2 may include a product as set forth in Variation 1 and further comprising the catch portion of the retainer having first and second catch members for retaining the striker in the notch to hold the hood in a partially open position, and said first and second catch members resiliently yielding to release the striker to permit opening of the hood without operation of the forkbolt.

Variation 3 may include a product as set forth in Variation 2 and further comprising the catch portion of the retainer having first and second catch members for retaining the striker in the notch to hold the hood in a partially open position, and said first and second catch members yielding to release the striker to permit opening of the hood without operation of the forkbolt, each of the first and second catch members having a ramp leading into the notch and an abutment overlying the notch to retain the striker within the notch.

Variation 4 may include a product as set forth in Variation 3 and further comprising the hood latch having a pair of coil springs and the attachment of the attachment portion of the retainer to the hood latch including inserting the attachment portion between the pair of coil springs.

Variation 5 may include a product as set forth in Variation 4 and further comprising the hood latch having a pair of coil springs and the attachment of the attachment portion of the retainer to the hood latch including inserting the base portion between the pair of coil springs. The catch portion of the retainer having first and second catch members for retaining the striker in the notch to hold the hood in a partially open position, and said first and second catch members yielding to release the striker to permit opening of the hood without operation of the forkbolt.

Variation 6 may include a product as set forth in Variation 5 and further comprising the hood latch having at least one pin pivotally mounting a lever and having a spring coil encircling the at least one pin, and the attachment of the retainer to the hood latch including the retainer having a notch for receiving the at least one pin or the spring coil encircling the at least one pin, and first and second attachment members for releasably attaching the retainer to the at least one pin or the spring coil encircling the at least one pin.

Variation 7 may include a product as set forth in Variation 6 and further comprising the hood latch having at least one pin pivotally mounting a lever and having a spring coil encircling the at least one pin, and the attachment of the retainer to the hood latch including the retainer having a notch for receiving the at least one pin or the spring coil encircling the at least one pin, and first and second attachment members for releasably attaching the retainer to the at least one pin or the spring coil encircling the at least one pin, and the catch portion of the retainer having first and second catch members for retaining the striker in the notch to hold the hood in a partially open position, and said first and second catch members yielding to release the striker to permit opening of the hood without operation of the forkbolt.

Variation 8 may include a product as set forth in Variation 7 and further comprising the forkbolt having a forkbolt recess for engaging and disengaging with the striker upon rotation of the forkbolt, and the attachment of the retainer to the latch including the retainer having a rod integral therewith and extending laterally from the attachment portion, said rod pin being engaged into the forkbolt recess for releasably attaching the retainer on the latch.

Variation 9 may include a product as set forth in Variation 8 and further comprising the forkbolt having a forkbolt recess for engaging and disengaging with the striker upon rotation of the forkbolt, and the attachment of the retainer to the latch including the retainer having a rod integral therewith and extending laterally from the attachment portion, said rod being engaged into the forkbolt recess for releasably attaching the retainer on the latch, and the catch portion of the retainer having first and second catch members for retaining the striker in the notch to hold the hood in a partially open position, and said first and second catch members yielding to release the striker to permit opening of the hood without operation of the forkbolt.

Variation 10 may include a product as set forth in Variation 9 and further comprising the attachment portion being integrally connected to the catch portion by a flexible neck.

Variation 11 may include a product comprising a retainer constructed and arranged for use in a vehicle having a hood with a striker and a hood latch with a forkbolt operable for latching and unlatching with the striker, a retainer for temporary use to releaseably connect the striker and hood latch without latching and unlatching the forkbolt, said retainer comprising: a body of molded resilient material having an attachment portion for attachment to the hood latch and a resilient catch portion integrally connected to the attachment portion; said resilient catch portion having at least one catch member for retaining the striker to hold the hood in a partially open position and for selectively releasing the striker to permit opening of the hood without operating the forkbolt; said hood latch having a pair of coil springs for biasing the forkbolt and a lever of the hood latch; and, said attachment portion of the retainer having a yieldable base inserted between the pair of coil springs to temporarily attach the retainer to the hood latch.

Variation 12 may include a product as set forth in Variation 11 and further comprising the resilient catch portion of the retainer having a notch and first and second catch members for retaining the striker in the notch to hold the hood in a partially open position, said first and second catch members resiliently yielding to release the striker to permit opening of the hood without operation of the forkbolt.

Variation 13 may include a product as set forth in Variation 12 and further comprising the base of the attachment portion having a plurality of holes therein to enhance the resilience of the base.

Variation 14 may include a product as set forth in Variation 13 and further comprising the pair of coil springs each having circular coils and the base of the attachment portion having concave surfaces that receive the circular coils to resiliently and removably attach the attachment portion to the hood latch.

Variation 15 may include a product as set forth in Variation 14 and further comprising the resilient catch portion of the retainer having a notch and first and second catch members for retaining the striker in the notch to hold the hood in a partially open position, said first and second catch members resiliently yielding to release the striker to permit opening of the hood without operation of the forkbolt; the base of the attachment portion having a plurality of holes therein to enhance the resilience of the base; and, the pair of coil springs each having circular coils and the base of the attachment portion having concave surfaces that receive the circular coils to resiliently and removably attach the attachment portion to the hood latch.

Variation 16 may include a product comprising a retainer constructed and arranged for use in a vehicle having a hood with a striker and a hood latch with a forkbolt operable for latching and unlatching with the striker, a retainer for temporary use to releaseably connect the striker and hood latch without latching and unlatching the forkbolt, said retainer comprising: a body of molded resilient material having an attachment portion for attachment to the hood latch and a resilient catch portion integrally connected to the attachment portion; said resilient catch portion having at least one catch member for retaining the striker to hold the hood in a partially open position and for selectively releasing the striker to permit opening of the hood without operating the forkbolt; said hood latch having at least one pin pivotally mounting a lever and having a spring coil encircling the at least one pin, and the attachment of the retainer to the hood latch including the retainer having a notch for receiving the at least one pin or the spring coil encircling the at least one pin, and first and second attachment members for releasably attaching the retainer to the at least one pin or the spring coil encircling the at least one pin.

Variation 17 may include a product as set forth in Variation 16 and further comprising the catch portion of the retainer having first and second catch members for retaining the striker in the notch to hold the hood in a partially open position.

Variation 18 may include a product as set forth in Variation 17 and further comprising the attachment portion being integrally connected to the catch portion by a flexible neck.

Variation 19 may include a product comprising a retainer constructed and arranged for use in a vehicle having a hood with a striker and a hood latch with a forkbolt operable for latching and unlatching with the striker, a retainer for temporary use to releaseably connect the striker and hood latch without latching and unlatching the forkbolt, said retainer comprising: a body of molded resilient material having an attachment portion for attachment to the hood latch and a resilient catch portion integrally connected to the attachment portion; said resilient catch portion having at least one catch member for retaining the striker to hold the hood in a partially open position and for selectively releasing the striker to permit opening of the hood without operating the forkbolt; said forkbolt having a forkbolt recess for engaging and disengaging with the striker upon rotation of the forkbolt; and, the attachment of the retainer to the latch including the retainer having a rod integral therewith and extending laterally from the attachment portion, said rod being engaged into the forkbolt recess for releasably attaching the retainer on the latch.

Variation 20 may include a product as set forth in Variation 19 and further comprising the resilient catch portion of the retainer having a notch and first and second catch members for retaining the striker in the notch to hold the hood in a partially open position, said first and second catch members resiliently yielding to release the striker to permit opening of the hood without operation of the forkbolt, and the attachment portion being integrally connected to the catch portion by a flexible neck.

The invention claimed is:

1. A temporary retaining system for use in a vehicle having a hood with a striker, the temporary retaining system comprising:

a hood latch with a forkbolt operable for latching and unlatching with the striker;

a retainer configured to releasably connect the striker and the hood latch without latching and unlatching the forkbolt, said retainer comprising a body of molded resilient material having an attachment portion for attachment to the hood latch and a resilient catch portion integrally connected to the attachment portion;

said resilient catch portion having at least one catch member for retaining the striker to hold the hood in a partially open position and for selectively releasing the striker to permit opening of the hood without operating the forkbolt;

said hood latch having a pair of coil springs for biasing the forkbolt and a lever of the hood latch; and said attachment portion of the retainer having a yieldable base inserted between the pair of coil springs to temporarily attach the retainer to the hood latch.

2. A temporary retaining system as set forth in claim 1 wherein said at least one catch member comprises first and second catch members which resiliently yield to release the striker to permit opening of the hood without operation of the forkbolt.

3. A temporary retaining system as set forth in claim 1 further comprising the yieldable base of the attachment portion having a plurality of holes therein to enhance the resilience of the yieldable base.

4. A retainer as set forth in claim 1 further comprising the pair of coil springs each having circular coils and the yieldable base of the attachment portion having concave surfaces that receive the circular coils to resiliently and removably attach the attachment portion to the hood latch.

5. A temporary retaining system as set forth in claim 1 wherein said at least one catch member comprises first and second catch members which resiliently yield to release the striker to permit opening of the hood without operation of the forkbolt;

the yieldable base of the attachment portion having a plurality of holes therein to enhance the resilience of the yieldable base; and, the pair of coil springs each having circular coils and the yieldable base of the attachment portion having concave surfaces that receive the circular coils to resiliently and removably attach the attachment portion to the hood latch.

* * * * *